United States Patent [19]

Haruch

[11] 4,343,434

[45] Aug. 10, 1982

[54] AIR EFFICIENT ATOMIZING SPRAY NOZZLE

[75] Inventor: James Haruch, Clarendon Hills, Ill.

[73] Assignee: Spraying Systems Company, Wheaton, Ill.

[21] Appl. No.: 144,642

[22] Filed: Apr. 28, 1980

[51] Int. Cl.[3] ..... B05B 7/10

[52] U.S. Cl. ..... 239/390; 239/403; 239/432; 239/467

[58] Field of Search ..... 239/403, 405, 432, 467, 239/470, 518, 524, 390

[56] References Cited

U.S. PATENT DOCUMENTS

| | | | |
|---|---|---|---|
| 1,012,436 | 12/1911 | Ransome et al. | 239/432 |
| 1,749,401 | 3/1930 | Tidy | 239/405 |
| 3,693,886 | 9/1972 | Conrad | 239/524 |

FOREIGN PATENT DOCUMENTS

| | | | |
|---|---|---|---|
| 90722 | 7/1961 | Denmark | 239/524 |
| 2291799 | 6/1976 | France | 239/405 |

*Primary Examiner*—Robert B. Reeves
*Assistant Examiner*—Paul A. Sobel
*Attorney, Agent, or Firm*—McWilliams, Mann & Zummer

[57] ABSTRACT

The invention comprises an atomizing spray nozzle containing multiple restrictions to the flow of an air and water mixture through the nozzle created by contours in the stem in relation to the orifice and having a whirl chamber in the nozzle body where injected air induces disturbances in the liquid to create effective atomization prior to the first restriction which creates a negative pressure beyond the restriction and which is repeated at additional restrictions thus resulting in a repeated depressurization and sudden expansion to obtain a finely atomized mixture before reaching the orifice, with a final restriction at an outlet that may take the form for a flat spray or one for a narrow round spray.

5 Claims, 13 Drawing Figures

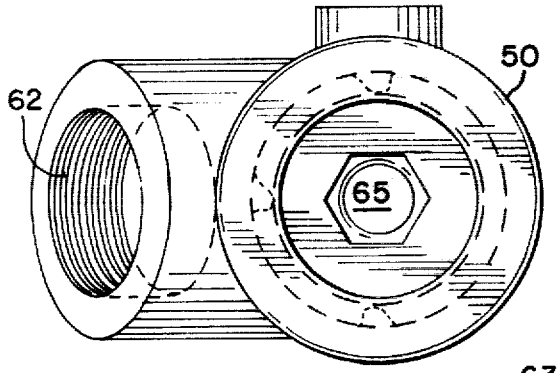
FIG. 2
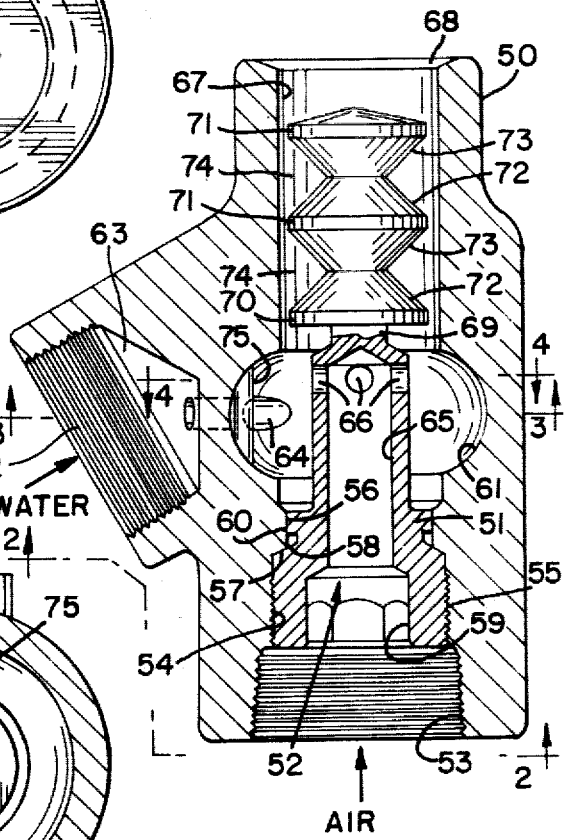
FIG. 1
FIG. 3
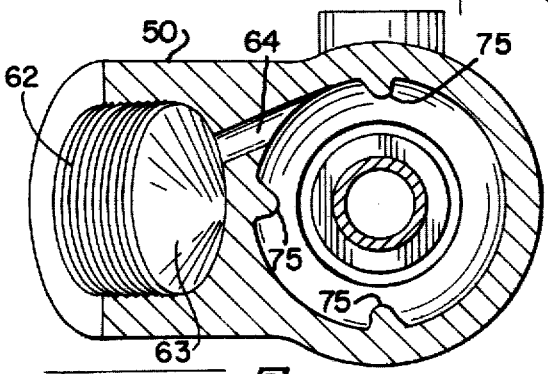
FIG. 5
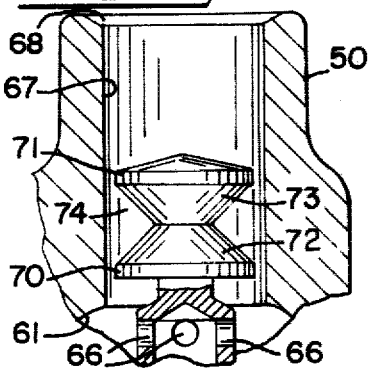
FIG. 4
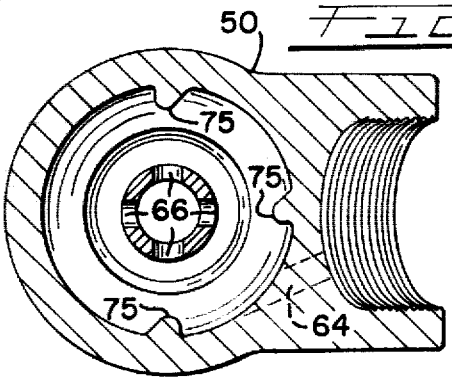

FIG. 9
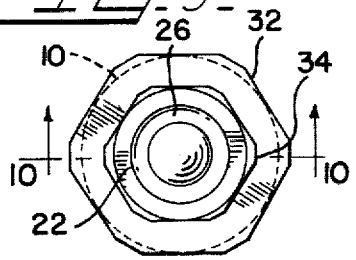
FIG. 11
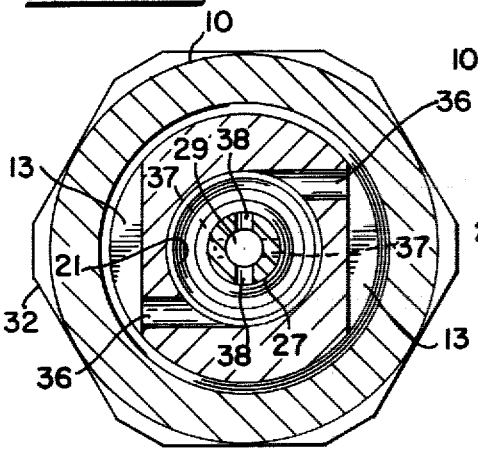
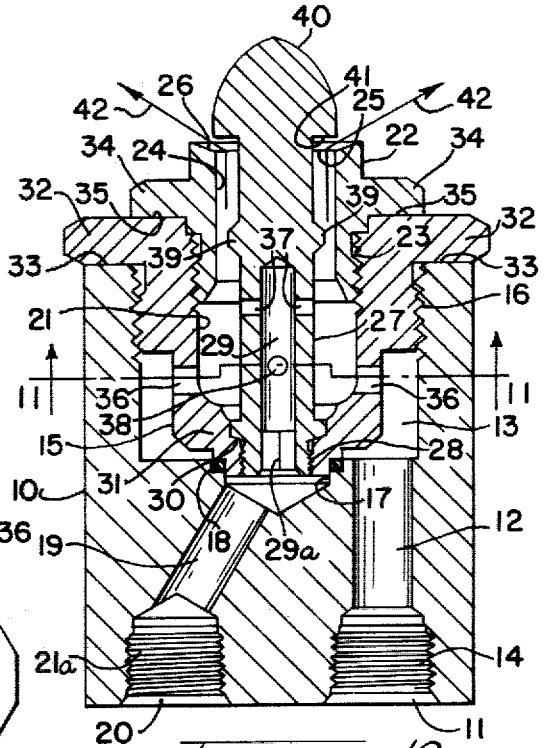
FIG. 10
FIG. 12
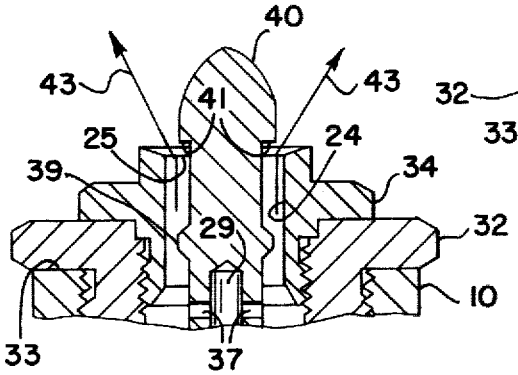
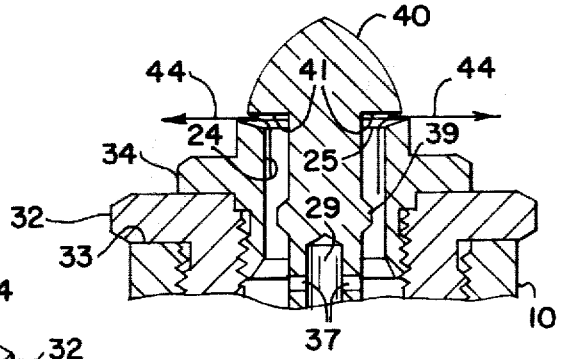
FIG. 13

AIR EFFICIENT ATOMIZING SPRAY NOZZLE

BACKGROUND OF THE INVENTION

1. Field of the Invention

In recent years there has been increasing concern with respect to air pollutants being spread into the atmosphere, both thermal and particulate, by industrial smoke stacks and a prime means of eliminating pollutants is by utilization of spray nozzles as a means of scrubbing the stack discharge. The ability of the spray nozzle to accomplish this resides in the capacity of the nozzle to increase the surface area of sprayed liquid to maximize the contact of the liquid with the pollutants, or to effect and facilitate maximum heat transfer. This is achieved by producing spray particles and the finer the particles the greater will be the surface area per unit volume of liquid sprayed from the nozzle.

Numerous spray nozzle designs are available in the prior art and represent the most versatile tools available to industry and agriculture that may be found today. The uses of such nozzles vary widely from crop spraying to snow making, to high impact washing, or gas scrubbing, or stack cooling, for example and these are but very few of the many uses to which such nozzles are related. The use of spray nozzles for various purposes is constantly growing and creates an ever increasing need for the energy required to operate the nozzles.

2. Description of the Prior Art

The production of fine spray particles in prior practices has been by forcing the liquid through small slots, or orifices, at sufficiently high pressure to impart a swirling action, or turbulence to the liquid, to cause it to atomize into fine spray particles upon exiting from the nozzle. Another nozzle commonly used for atomizing, utilizes high pressure compressed air for the purpose of providing the mechanical energy to break up the particles and facilitate atomization, which is usually accomplished by directly impinging the air stream on the liquid. Both such methods in practice are uneconomical in practice and very expensive, because large air compressors must be used and high pressure pumps of great capacity must be utilized in order to afford the capacities that are required for the efficient and effective scrubbing and cooling of the stack gases.

SUMMARY OF THE INVENTION

The atomizing nozzle of this invention can be operated either as a straight hydraulic nozzle using only liquid, or it may be assisted by the addition of air to achieve maximum spray particle break up and fine atomization whereby to make the greatest utilization and efficient use of either, or both such sources of power for operating the nozzle. When this nozzle is operated in the air assisted mode it affords the most efficient nozzle, utilizing less compressed air and achieving finer atomization than any nozzle known in the prior art which uses compressed air in relation to a liquid volume.

A unique feature of the present nozzle is the means utilized for air atomization which combines the liquid break up arrangements used in both pneumatic and hydraulic nozzles. As an example, the liquid is conditioned for air atomization by hydraulic forces which, normally, would atomize the liquid without the addition of pressurized air and at this sensitive point in the transition of the liquid flow within the confines of the nozzle, air is added and applied to the liquid in such manner as to take full advantage of the fluid instabilities and thereby further atomize the liquid to a much greater degree than would be possible utilizing hydraulics solely. This nozzle inherently has the ability to operate effectively without the addition of pressurized air, or to use as much, or as little air, as necessitated by the degree of atomization desired, from relatively coarse spray particle size afforded by straight hydraulic operation, to the very fine atomized spray particles afforded by the added air atomization. This ability affords the most efficient utilization of both hydraulic and pneumatic energy by using a proper combination of air and liquid pressures and particularly adapted to making snow, as at ski resorts.

This atomizer nozzle arrangement includes a nozzle body that incorporates an air inlet and a liquid inlet. One form of the invention provides a nozzle incorporating a whirl chamber where liquid enters tangentially to form a thin sheet which impinges against outstanding ribs on the inner surface of the chamber to induce turbulence of the liquid by injection of pressurized air into the unstable film of spinning liquid to create efficient atomization followed by a restriction and then one or more additional restrictions which cause repeated depressurization and sudden expansion at each restriction to provide a finely atomized mixture of the liquid with air prior to reaching the discharge orifice of the nozzle.

In a second form of the nozzle a first chamber is defined within the nozzle body and is in communication with the liquid inlet. A whirl chamber body is disposed at least partially within this first chamber and includes a whirl chamber within the second body. Orifices are defined in the side wall of the whirl chamber body to communicate liquid from the first chamber to the outer periphery of the whirl chamber with substantial tangential velocity. An air stem is disposed within the whirl chamber body and includes an inlet at one end in communication with the air inlet, a hollow chamber, a plurality of ports defined in the side walls of such stem to transmit air from the hollow chamber to the whirl chamber and an annular projection on the stem which, together with the internal wall of the whirl chamber body, defines a restricted orifice through which a mixture of air and liquid must pass to enter the orifice.

An air deflection cap in this second form is located at the end of the air stem remote from the air inlet to influence the direction of spray particles discharged from the nozzle and acts as a second restriction to again depressurize the mixture which is then suddenly expanded once more, effectively to atomize the mixture issuing from the nozzle. The stem and deflection cap in this form are removable from the whirl chamber body and are interchangeable with stems having deflection caps of different diameters. The deflection cap controls the spray angle of the discharge through the nozzle and the manner of effecting the spray angle and controlling, as well as varying the angle, is obtained by the interchangeable feature of the deflection cap which has the ability to atomize the liquid passing through the nozzle with, or without the addition of compressed air.

While prior spray nozzles may have produced a symmetrical pattern in the spray by means of a deflection plate, they controlled the spray angle by causing the fluids to flow smoothly along, or impinge against, an angled surface on the plate and utilized this angled surface to determine the spray angle of the discharge. This nozzle arrangement does not vary the angle of any surface on the deflection cap to change the spray angle of the nozzle discharge, but instead provides an air stem having a deflection cap of a diameter to provide the desired spray angle. The angle of the surface area on the deflection cap which spreads the exiting spray, remains constant on all interchangeable caps and which, as shown, is at ninety degrees (90°) to the axis of the air stem. This arrangement of the deflection surface in relation to the orifice cap causes a pressure wave to be generated and thereby obtain the spray angle desired and by controlling the direction and expansion of the combined air-and—liquid mixture, the exit angle of the fluid can be regulated and controlled more or less precisely throughout the general operating range of the nozzle.

Further, the contraction at the restriction in the nozzle and then the sudden expansion of the air-and-liquid mixture at this point and again at the restriction provided by the cap and orifice relationship contributes importantly to the atomization of the mixture by the multiple restrictions thus afforded.

OBJECTS OF THE INVENTION

The primary purpose of the invention is the provision of a spray nozzle which can be operated either hydraulically, or assisted by compressed air, to achieve very fine atomization and obtain efficient utilization of either, or both of such energy sources.

The principle object of the invention is the provision of a spray nozzle having an orifice wherein a restriction creates an annular constriction in the flow of fluid which results in a sudden expansion and depressurization, which is repeated one or more times to provide added turbulence and cause the fluid to become more finely atomized.

An important object of the invention is to provide a spray nozzle having an interior whirl chamber having interior ribs to destabilize the liquid wherein the liquid passing through the nozzle attains axial and radial velocities as determined by the diameter of the chamber and the applied liquid pressure and where high pressure air may be added to obtain fine atomization.

A further object of this invention is the provision of an atomizing spray nozzle having a body containing a whirl chamber, an air stem secured in the body and extending into the whirl chamber, and an extension on the air stem disposed in the orifice passage of the nozzle having one or more restrictions on the extension providing pressurization and expansion areas between the restrictions and pressurization and expansion area beyond the final restriction.

A more specific object of one form of the invention is to provide a spray nozzle assembly including a first body having a liquid chamber, a second body having a whirl chamber threaded into the first body, an orifice threaded into the second body and a stem extending through the orifice and threaded into the second body, with a liquid passage in the first body into the liquid chamber, an air passage through the first body in communication with the stem, and liquid passages through the second body into the whirl chamber so located as to impart radial velocity to liquid in the whirl chamber and air passages through the stem into the whirl chamber to add high pressure air to the liquid before it passes through the orifice.

Another specific object of this invention is to provide an atomizing nozzle having interchangeable deflection caps for varying the spray angle of the nozzle discharge without varying the angle of the deflection surface on the respective caps.

DESCRIPTION OF THE DRAWINGS

The foregoing and other and more specific objects of the invention are attained by the nozzle structure and arrangement illustrated in the accompanying drawings wherein FIG. 1 is a general longitudinal sectional view through a first form of the atomizing spray nozzle showing a threefold restriction and expansion type of orifice;

FIG. 2 is an end elevational view of the nozzle showing the nozzle from the air and liquid entrances;

FIG. 3 is a transverse sectional view through the spray nozzle taken on the line 3—3 of FIG. 1;

FIG. 4 also is a transverse sectional view through the nozzle taken on line 4—4 of FIG. 1 but looking in the opposite direction from FIG. 3;

FIG. 5 is a fragmentary view of a modified form of restriction for the nozzle utilizing a twofold type of restriction and expansion elements;

FIG. 9 is a top plan view of the exit end of a second form of the nozzle, which is drawn to smaller scale than the remaining drawing figures of this form;

FIG. 10 is a vertical transverse sectional view through this nozzle taken on the line 10—10 of FIG. 9;

FIG. 11 is a horizontal sectional view through the nozzle taken on the line 11—11 of FIG. 10;

FIGS. 12 and 13 are fragmentary sectional views similar to FIG. 10 illustrating interchangeable alternate air stems and deflection caps for use with the arrangement of FIG. 12 which shows a smaller diameter deflection cap than that illustrated in FIG. 10.

DESCRIPTION OF THE FIRST EMBODIMENT

Figure 7:
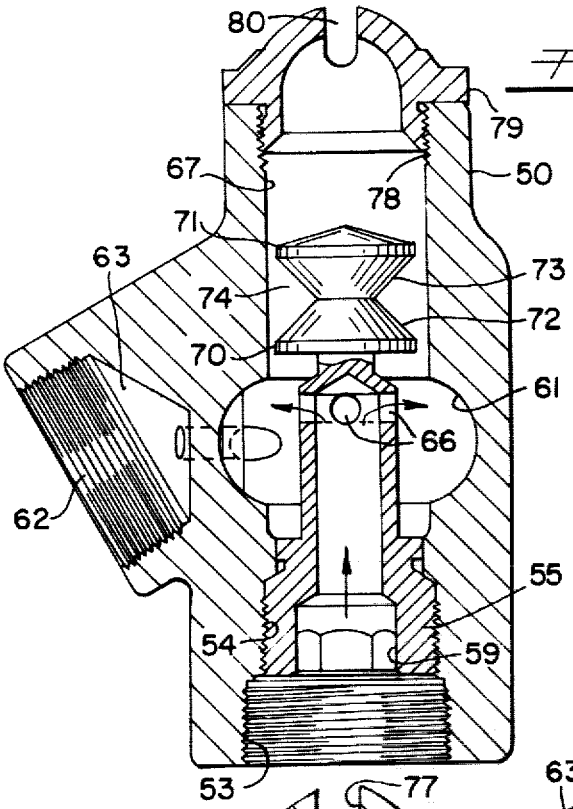
FIG. 7 is a view similar to FIG. 6 also illustrating a flat spray type outlet but utilizing a removable element whereby different types of outlets are useable by merely changing this element.

The air efficient atomizing spray nozzle of this form of the invention is illustrated in FIGS. 1 through 8 where it is readily seen that the entire nozzle assembly includes only two parts comprising a main nozzle body 50 and a separate air stem unit 51. The nozzle main body 50 is provided with an air entrance opening 52 at one end and which is internally threaded as at 53 for the reception of an air line from a suitable source of compressed air (not shown).

A second threaded opening 54 at this end of the body 50 is provided for mounting the air stem 51 which is threaded as at 55 for securement in the opening 54. The opening 54 is of smaller diameter than the entrance opening 52 and a third opening 56 of still smaller diameter is provided in this area of the nozzle body and which affords a sloping seat 57 for an annular shoulder 58 on the air stem. The engagement of the shoulder 58 with the seat 57 provides a seal which is enhanced by the angularity of the surfaces.

The air stem is provided with an open hexagonal socket 59 for the insertion of a suitable tool to tighten the stem unit into the threads 55 against the seat 57. The air stem 51 also has an annular collar 60 having a close fitting engagement within the opening 56.

Intermediate the length of the nozzle body 51 a central whirl chamber 61 is provided for the effective mixing of liquid and pressurized air to provide a mixture for atomizing and subsequent processing through the nozzle. Equally spaced outstanding ribs 75 are provided on the interior surface of the whirl chamber providing projections against which the incoming liquid impinges to form an unstable thin sheet, or film of spinning liquid. At one side of the nozzle body in the general area of the whirl chamber 61 a liquid inlet 62 is provided which also is internally threaded for the securement of a liquid supply line from a suitable source of liquid (not shown). The inlet leads to a liquid chamber 63 from which liquid is supplied to the whirl chamber 61 through an opening 64. As best shown in FIG. 3, the opening 64 is tangentially disposed relative to the whirl chamber so that liquid discharged under pressure into the whirl chamber is immediately swirled about the periphery of the chamber to form the spinning sheet of liquid and obtain the greatest possible agitation and turbulence by the impingement of the liquid directly against the ribs 75.

The air stem structure 51 extends into the whirl chamber 61 and is adapted to supply air under pressure to the liquid in the chamber. The air stem 51 includes an internal air chamber 65 from which pressurized air is discharged into the whirl chamber at intervals of substantially 90° to each other through openings 66 and substantially perpendicularly to the air stem axis so that with the four jets of air impinging into the swirling sheet of liquid an exceedingly active and thoroughly efficient mixing of the air and water is achieved with the greatest possible turbulence to achieve a thorough mixture suitable for atomizing in its subsequent passage through the nozzle. The air is conducted through the air chamber 65 and transmitted perpendicularly against the unstable liquid film through the right angle openings 66 at high velocity to create maximum agitation and turbulence.

It should be noted that the air discharge openings 66 are displaced longitudinally, or axially of the nozzle, from the liquid inlet opening 64 so that mixing of the air and liquid occurs in the whirl chamber without any possibility of an air jet discharging directly into the liquid entrance opening 64 and in this way the most effective and efficient mixing of the two fluids is obtained. The air stem 51 occupies a central position in the whirl chamber 61 so that with the liquid being injected into the chamber tangentially from the opening 64 and the four air jets issuing radially from the openings 66 at equally spaced intervals the liquid swirling about the periphery of the whirl chamber is thoroughly and completely intermingled and mixed with air to provide a desired mixture for passage into the orifice passage 67 which leads to the discharge orifice 68. The spinning air and liquid mixture is forced into the orifice passage 67 and constricted, after which the mixture is allowed to expand and then constricted and expanded again, possibly going through this constriction and expansion process several times prior to being formed into the desired pattern to be discharged through nozzle orifice 68.

The air stem 51 projects into the whirl chamber 61 for substantially the full extent of the chamber and is provided with an extension 69 that projects into the orifice passage 67 and most importantly to this inventive concept this extension includes a first restriction 70 and subsequent restrictions 71 here shown as comprising a total of three restrictions including the first element 70 and the subsequent elements 71 all located in the passage 67. These restrictions act to constrict the passage at spaced locations with expansion areas after each constriction and increase the efficiency and effectiveness of the atomizing action of this nozzle by increasing the turbulence of the air and liquid mixture just prior to discharge of the mixture through the orifice 68. Thus, when this nozzle is utilized for making snow the chosen spray pattern exists from the nozzle orifice 68 and freezes immediately into minute ice crystals for spraying onto a ski slope or run. The spray may be discharged in a flat fan pattern, or a narrow angled round spray pattern, which may be regulated by the type of orifice exit control utilized at the discharge exit together with the constriction used in the passage 67.

Figure 6:
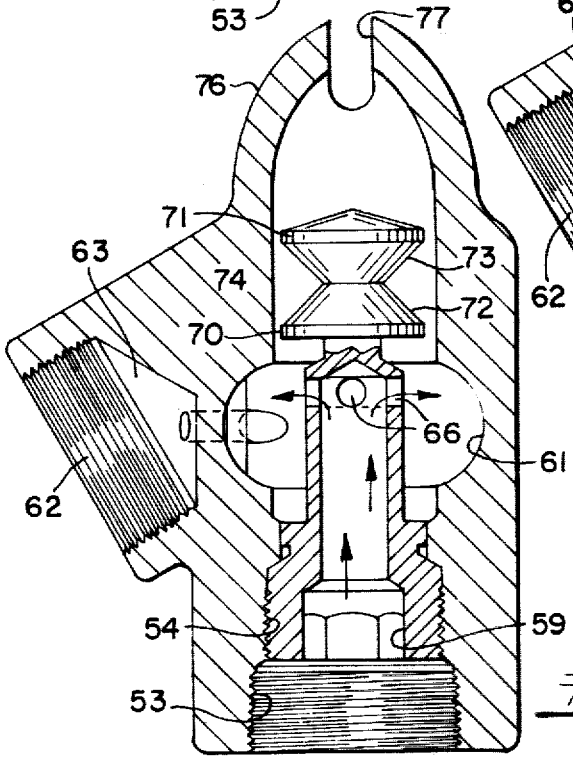
FIG. 6 is sectional view through a modified form of the nozzle which utilizes a flat spray type of discharge outlet.

The flat spray type orifice is illustrated in the nozzles shown in FIGS. 6 and 7 and the discharge orifice may be incorporated as an integral part of the nozzle as in FIG. 6 or it may be formed as a separate element containing the orifice and which is screwed into the nozzle body as indicated in FIG. 7. These nozzles have two element restrictions 70 and 71 as more fully hereinafter described in reference to the general arrangement of the multiple restriction type of nozzle. The same general reference characters are applicable to the various features of FIGS. 6 and 7 and also FIG. 8, as is used particularly in FIGS. 1 and 5.

As shown in FIG. 6 the discharge end of the nozzle is formed with an integrally designed orifice structure which tapers toward the outlet as at 76. The discharge outlet 77 is in the form of a slotted opening that causes the discharge to issue in a flat spray that makes the nozzle particularly adaptable to the making of snow. The nozzle is of high flow capacity and this contributes also to its advantageous use in the production of snow. When used with the two element restriction in the nozzle the flat spray orifice 77 acts as a third restriction at the outlet thus providing a nozzle having three constrictions at spaced locations further to increase the efficiency and effective atomizing action of the two element type nozzle.

In the form of the nozzle shown in FIG. 7 the nozzle body is internally threaded, as at 78 and the discharge outlet is formed as a separate element 79, which might be called an orifice cap that is threaded into the threads 78 to secure the discharge element into the nozzle body. The outlet 79 is provided with an orifice 80 that is elongated similar to the slot 77 in the discharge end 76 of the nozzle of FIG. 6, thus affording the same advantageous flat spray pattern discharged from the nozzle for the effective production of snow. By threading the outlet element 79 into the nozzle the orifice becomes interchangeable with other elements incorporating orifices of effectively different spray pattern capabilities whereby the nozzle may readily be adapted to various conditions.

Figure 8:
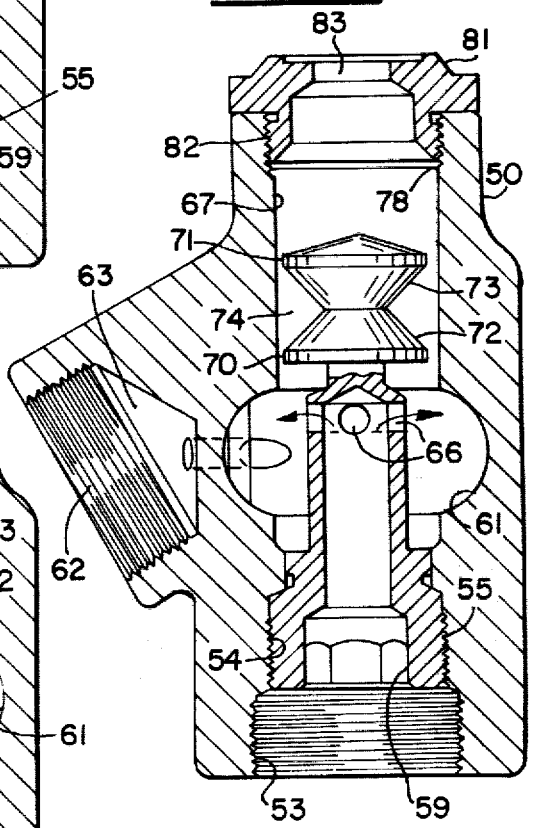
FIG. 8 is a view similar to FIG. 7 utilizing a removable outlet element but having a narrow round spray type of discharge outlet.

The construction of the nozzle forms of FIGS. 7 and 8 have the effect of adding a third part to the two part design of FIGS. 1 through 6 in that the interchangeable discharge element is secured into the discharge end of the nozzle body structure thus adding to the assembly comprised of the nozzle body 50, the air stem 51 and now the discharge element 79 in FIG. 7 and corresponding element 81 in FIG. 8. In this latter Figure the discharge element 81 is threaded into the nozzle body as at 82 similarly to the securement of the discharge member 79 in FIG. 7. The member 81 however, is designed to provide a narrow round spray upon discharge to atmosphere. For this purpose the orifice 83 is round so that the spray discharged will issue in a round pattern.

The nozzle indicated in FIG. 5 incorporates two constriction areas 70 and 71, the nozzle of FIG. 1 utilizes three constricted areas 70, 71 and 72 respectively while the nozzles of FIGS. 6, 7 and 8 each provide three constriction areas by reason of the inclusion of the restricted orifice 77, 80 or 83, as the case may be but if these orifices were to be used with the three element restriction afforded by the stem structure shown in FIG. 1, then the number of constricted areas would be increased to four, thus providing the most effective spray discharge specifically adapted to the production of snow.

The multiple restrictions 70 and 71, as shown, are formed integrally with the air stem extension and are generally in the form of opposed frustums integrally connected at what might otherwise comprise their respective cut off top planes so that their sloping surfaces 72 and 73 provide an annular valley between the spaced maximum diameter restrictive portions 70 and 71. These valleys provide areas 74 between the restrictions where the air and liquid mixture after being constricted through the restrictions 70 and 71 suddenly expand into the areas 74 and create a turbulence that further breaks up the mixture and atomizes the mixture very effectively because of the repetitive restriction and sudden expansion.

Similar constrictions of the mixture occur again at the restrictions 71 where the mixture is repeatedly caused to expand suddenly in the areas 74 between the restrictions and beyond the restrictions in the orifice 68 in the most effectively atomized condition possible. This repeated constriction and sudden expansion of the air and liquid mixture in the negative pressure areas 74 between the restriction and again beyond the final restriction while still in the orifice passage 67 results in a more efficient operation of the nozzle in developing a finely atomized mixture for discharge from the nozzle and actually requires less energy in the amount of compressed air required to achieve a degree of atomization not attained by any other spray nozzle now available. A highly turbulent mixing of the air and liquid is achieved especially as a result of the repeated constrictions through which the mixture must pass, each of which causes a depressurization and sudden expansion of the mixed fluids as the mixture passes through the restrictions into the negative pressure areas beyond each restriction. The repetitive pressure drop also has the effect of inducing flow of the atomized mixture toward the orifice 68 and actually prevents any possibility of back flow toward the supply lines.

In FIG. 1 the restrictions 70 and 71 are shown as comprising a total of three elements which constrict the flowing mixture at each location and cause the mixture to expand suddenly at each subsequent low pressure area but the number of restrictions may be varied in accordance with the intended use of the nozzle. FIG. 5 illustrates a modification of the nozzle wherein but two restrictions are provided. As shown here, the air stem extension 69 is provided with a first restriction 70 followed by low pressure area 74 and then the second restriction 71, which forms the final constrictions after which the liquid and air mixture expands suddenly in the low pressure area afforded by the orifice passage 67. This nozzle arrangement affords the same multiple constriction and expansion of the fluid mixture for effective atomization of the liquid and air mixture but does so twice instead of three times as in the nozzle of FIG. 1.

DESCRIPTION OF SECOND EMBODIMENT

The nozzle assembly of this form of the invention is best shown in its entirety in FIG. 10, where it will be seen that it contains four parts but which include elements imparting functions that contribute importantly to the improved operation of the nozzle. The nozzle includes a main body 10 having a liquid inlet 11 having a passage 12 leading to a liquid chamber 13. The inlet 11 is threaded, as at 14 for attachment of a supply pipe (not shown) having connection with a suitable source of liquid supply.

A separate whirl chamber body 15 is threaded into the nozzle main body, as at 16 and extends through the liquid chamber 13 to seat in an interior opening 17 in the main body 10 with a gasket 18 providing a seal between the bottom end of the body 15 and around the opening 17 in the main body. The opening 17 communicates with a passage 19 in the main body leading to an air inlet 20 which is threaded, as at **21*a*, for connection with a suitable source of air under pressure. By the disposition of the whirl chamber body 15 in the main body chamber 13, the liquid chamber becomes in effect, a pair of chambers separated by the whirl chamber body, as best indicated in FIG. 10, but connected under and around the bottom of the whirl chamber body, as best shown in FIG. 10. The reservoir of liquid thus provided, is supplied from the inlet 11**.

The body 15 includes a whirl chamber defined by interior circular wall 21 and an orifice cap 22 is threaded into the whirl chamber body, as at 23, with an opening or passage 24, extending through the cap 22 from the whirl chamber 21 to the orifice 25, the upper surface of which is beveled, as at 26. Extending through the orifice cap 22 and into the whirl chamber 21, is an air stem 27, which is threaded into the base of the chamber, as at 28, in axial alignment with the opening 17. Thus, the air stem 27, which is hollow to form an air chamber 29 therein, is in direct communication with the air supply through the opening 17 and passage 19. A shouldered seat 30 affords a general sealing arrangement with the whirl chamber bottom wall 31, so that air does not escape at this point into the whirl chamber 21.

The whirl chamber body 15, the orifice member 22 and the air stem 27 may be preassembled for application as a subassembly into the nozzle body 10 and for this purpose the air stem 27 at its lower end is provided with an internal hexagonal socket **29*a* (see FIG. 10) opening downwardly for the reception of a suitable wrench to tighten the stem into the threaded bottom opening therefor in the bottom wall 31** of the whirl chamber.

The whirl chamber body is horizontally flanged, as at 32, and this flange seats on the top edge 33 of the main body 10 and the orifice cap 22 is horizontally flanged, as at 34, and this flange seats on the annular top surface 35 of the whirl chamber. Thus, the assembled parts of the nozzle provide an entity wherein all of the parts thereof are in axial alignment and function to cooperate fully in the attainment of the ultimate goal of providing an operative nozzle that acts as an integrated whole.

The two sides of the liquid chamber 13 have direct communication with the whirl chamber 21 by means of diagonally opposite openings 36 through the circular wall of the whirl chamber body 15 and as best shown in FIG. 10, it will be seen that these openings are located in positions whereby liquid issuing into the whirl chamber 21, does so at the periphery of the whirl chamber at equally spaced locations so that an ultimate swirl effect is achieved with the utmost velocity afforded by the pressure under which the liquid is injected.

The air chamber 29 in the air stem 27 is in direct communication with the air inlet 20 through the passage 19 and is adapted to inject this high pressure air into the whirl chamber 21 through openings 37 and 38 at vertically spaced upper and lower locations extending through the surrounding wall of the chamber 29 in positions at 90° to each other in respect to the four holes represented by the upper and lower level openings. Thus, with the liquid flowing around the periphery of the whirl chamber, the high pressure air is injected in a manner to induce the greatest disturbances in the liquid to break it up and create the greatest atomization.

This highly turbulent mixture of liquid and air passes upwardly through the orifice passage 24 and is further acted upon by a restriction 39 in this passage provided by an annular projection encircling the air stem 27 and which constricts the orifice passage and then causes a depressurization and sudden expansion of the fluids upon passing this constriction so that the mixture is finely atomized before reaching the orifice exit where a second restriction is encountered at the orifice 25, created by the deflector cap surface 41, where a depressurization and sudden expansion occurs as the mixture is discharged from the nozzle. This pressure drop also induces the fluids to flow continuously to the orifice 25 and prevent back flow of the liquid into the air line connected with the inlet 20.

The air stem 27 is designed to be interchangeable with other stems that are modified to the extent of having an air deflection cap of different diameter. In FIG. 10, it will be seen that the deflector cap 40 has a certain maximum diameter substantially greater than the diameter of the stem 27 so that a horizontal shoulder is formed at the point where the cap joins the stem and this right angle relationship holds true regardless of the diameter of the cap. The perpendicular shoulder comprises a deflector surface 41 that is always disposed in this horizontal plane and in generally the same spaced relationship above orifice 25. The arrows 42 in FIG. 10 indicate the spray angle obtained with this particular deflector cap and orifice relationship.

In FIG. 12, it will be seen that the deflector cap 40 has a smaller overall diameter than that illustrated in FIG. 7, so that the horizontal deflector surface 41 has a substantially different relationship to the orifice 25 and whereby the spray pattern assumes the angle indicated by the arrows 43. However, in FIG. 9, the deflector cap 40 has a larger maximum diameter and consequently the deflector surface 41 has a substantially different relationship to the orifice 25 and results in a spray pattern that issues from the nozzle in a substantially horizontal spray, as indicated by the arrows 44. In all of these spray caps the spray surface 41 is perpendicular to the axis of the stem 27 and the variation in the spray patterns is obtained only by changing the diameter of the deflector surface 41 and the relationship thereof to the orifice 25.

In the operation of this form of nozzle, liquid enters the whirl chamber 21 tangentially through the similarly positioned openings 36 and the liquid spins around the periphery of the whirl chamber 21 developing a velocity under the liquid line pressure, such that it passes through the orifice passage 24 in a thin sheet, or web of liquid. As the liquid is ejected through the orifice 25 it undergoes a relative fluctuation in its velocity and in passing over the edge 26 of the orifice these fluctuations form disturbances, in the nature of waves in the liquid web as this web extends away from the nozzle outlet and rapidly becomes thinner and begins to tear at the troughs of the waves. These tears expand rapidly causing the web to break up and finally disintegrate into spherical drops. The cone angle of the spray from this type of break-up can be described as a function of the axial and radial velocities of the liquid and this is determined by the diameter of the whirl chamber, the applied line pressure on the liquid and the ratio of the length of the orifice in relation to its diameter.

An important feature of this form of the invention as in the first embodiment, is the method utilized for adding air to further atomize the liquid which combines the liquid break-up features for use in both pneumatic and hydraulic nozzle operation. In operation of the nozzle for air atomization the liquid is first conditioned for such operation by the hydraulic forces that would normally atomize the liquid even though no air is supplied. This represents a very sensitive point of transitional liquid flow within the confines of the nozzles and when air is supplied at this point in a manner to take full advantage of the fluids instabilities the liquid will be further atomized to a far greater degree than either force would be capable of accomplishing if used alone.

During the combined air assisted operation the air from the inlet 20, or 52, is conducted through the center air stem 27, or 51 and enters the whirl chamber 21, or 61, through the cross-directed openings 37 and 38, or 66, at very high velocity. The liquid from the inlet 11, or 62, enters the whirl chambers 21, or 61, through the tangentially disposed inlet openings 36, or 64, so that the liquid immediately circles around the whirl chamber and spreads into a rapidly spinning thin sheet around the inside circular surface 21, or 61, of the whirl chamber.

The incoming air streams impinge this thin sheet of liquid in a perpendicular relationship and thus create a great amount of turbulence and violently forceful mixing of the air with the liquid. This air-and liquid mixture passes from the whirl chamber interior into the passage 24, or 67 and as the mixture passes the annular constrictions 39, or 70/71, depressurization occurs as a result of the flow of the mixture from the relatively large volume of the whirl chamber through the constrictions and then suddenly expanded in the spaces beyond the restrictions.

In the second form of the invention, this sudden expansion has the effect of causing the air-liquid mixture to be finely atomized prior to being formed into the precise spray pattern and spray discharge angle at the nozzle orifice 25 defined between the deflector surface 41 and the surface 26. The sudden pressure drop across the restriction 39 also has the beneficial effect of inducing a continuous flow toward the orifice 25 and thus prevents any tendency of the liquid to flow back through the air line 19, 20, especially when air is not being supplied to the mixture. This advantageous effect is achieved because a slight negative pressure condition is created as the liquid passes from the whirl chamber interior 21 through the annular area across the restriction 39 on the air stem 27 within the orifice passage area 24. The pressure drop referred to is actually caused by the contraction and sudden expansion of the air being moved with the liquid flowing through this area, so that in reality, the liquid does not come into physical contact with the restriction 39.

SPRAY ANGLE OF ATOMIZED DISCHARGE

At the orifice 25, the cone angle of the discharged spray can be varied by changing the diameter of the deflecting surface 41. This surface is an integral part of the deflector cap 40 and the cap, of course, is an integral part of the air stem 27, so that by changing the air stem illustrated in FIG. 7 for one or the other of the stem and cap members shown in FIGS. 8 and 9, the cone angle of the discharged spray can be varied as desired, or as necessary to accomplish the purpose required. By use of this interchangeable feature of the deflection caps 40 a variation of the spray angle from about 40° to about 180° can be obtained without any change in liquid flow for given air and liquid pressures.

The spray angle is formed by the annular fluid mixture flow around the deflection cap 40 and by changing the diameter of the deflector surface 41 the spray angle can be modified as required. By utilizing a smaller diameter of the surface 41 the spray is spread less and more of the spray is thrust forward in a direction to form a narrower spray angle, or cone. By using one of the larger diameter caps 40 the discharged spray will be spread outwardly as much as at generally a right angle to the nozzle, thus keeping the spray angle wide and with a relatively lower forward velocity.

In practice, the larger the diameter of the cap 40 that is used, the larger the area will be of the deflector surface 41, which spreads the spray outwardly and the smaller the diameter of the cap 40 that is used, the smaller the area of the deflector surface 41 will be, thus keeping the spread of the spray within the lesser angle and more of the spray is thrust forward within this narrower spray angle, so that the more precisely the diameter of the deflector surface 41 is controlled, the more precisely can the spray angle discharged from the nozzle be controlled. The interchangeable deflector cap feature therefore enables this nozzle to be modified to the extent of enabling the utilization of discharged spray angles varying from the angle 43 shown in FIG. 8, or the angle 42 indicated in FIG. 7, to the angle 44 shown in FIG. 9, all of which is obtained merely by removing one stem 27 and substituting another with the deflector cap 40 of the desired diameter.

CONCLUSION

From the foregoing it will be seen that a nozzle has been provided that will operate as a straight hydraulic nozzle, or which will operate with the addition of high pressure air to provide as much, or as little atomization as may be desired, or to the degree of atomization required, from a relatively coarse particle size, as obtained with the straight hydraulic atomization, to the very fine atomized particles achieved with the addition of high pressure air to the mixture in the manner herein described. The invention permits most efficient use of either hydraulic, or pneumatic energy, or both, by utilizing a proper combination of air pressure and liquid pressure.

Importantly, the nozzle incorporates multiple restrictions to the flow of the air and liquid mixture which create repeated depressurization and sudden expansion of the mixture beyond each restriction to create further turbulence and obtain more efficient atomization of an increasingly finer mixture resulting from the negative pressures at the discharge side of the respective restrictions and using less energy as provided by compressed air than other available nozzles.

What is claimed is:

1. An atomizing spray nozzle including a nozzle body having an entrance opening for liquid and an entrance opening for air and an orifice passage, said passage being elongated, a liquid whirl chamber in the nozzle body in communication with said liquid entrance opening located behind said orifice passage of greater diameter than such passage and of less axial extent than the passage, a tangential inlet admitting liquid to the whirl chamber from said entrance opening, a central air stem containing an air chamber mounted in the nozzle and extending into the whirl chamber, a plurality of laterally directed openings in the air stem admitting air from said air chamber, said openings being disposed to discharge air into the whirl chamber at positions axially spaced from said inlet, said air stem having an extension into said elongated orifice passage, a restriction on said extension within said passage to form a constriction in the passage and cause a depressurization and sudden expansion of the liquid and air mixture, and means for varying the spray angle of the nozzle discharge comprising an interchangeable stem having a deflection cap including a deflection surface having a fixed angularity to the axis of said stem, said deflection cap disposed outwardly of the orifice passage with said deflection surface in spaced relation to the orifice such as to define an annular emission opening effecting the spray angle of the nozzle discharge.

2. An atomizing spray nozzle as set forth in claim 1 wherein said whirl chamber comprises a separate body secured in the nozzle body and said stem is secured in the whirl chamber.

3. An atomizing spray nozzle as set forth in claim 2 wherein said whirl chamber body is threaded into said nozzle body and has a bottom centrally disposed seat mounted in an interior opening in the nozzle body in communication with said air inlet, said stem member being threaded into said whirl chamber body, and said stem extends through the orifice passage and is threaded into the base of the whirl chamber whereby the air chamber in the stem is in communication with the air inlet.

4. An atomizing spray nozzle as set forth in claim 1 wherein said air discharge openings are disposed at intervals and substantially perpendicular to the axis of the air stem, and are disposed at 90°.

5. An atomizing spray nozzle as set forth in claim 1 wherein said orifice is incorporated in a separate spray cap.

* * * * *